US010465385B2

(12) United States Patent
Satterfield et al.

(10) Patent No.: US 10,465,385 B2
(45) Date of Patent: Nov. 5, 2019

(54) CLEAN ROOM CEILING, SYSTEM AND INSTALLATION METHOD

(71) Applicant: AES Clean Technology, Inc., Montgomeryville, PA (US)

(72) Inventors: Louis C. Satterfield, Gwynedd, PA (US); Robert G. Satterfield, Ambler, PA (US); Robert J. Bright, Sellersville, PA (US); Robert J. Geiger, North Wales, PA (US)

( * ) Notice: Subject to any disclaimer, the term of this patent is extended or adjusted under 35 U.S.C. 154(b) by 0 days.

(21) Appl. No.: 15/185,822

(22) Filed: Jun. 17, 2016

(65) Prior Publication Data

US 2017/0362829 A1 Dec. 21, 2017

(51) Int. Cl.

| | |
|---|---|
| ***E04B 9/04*** | (2006.01) |
| ***E04B 9/06*** | (2006.01) |
| ***E04B 9/24*** | (2006.01) |

(52) U.S. Cl.

CPC ..... *E04B 9/247* (2013.01); *E04B 9/04* (2013.01); *E04B 9/06* (2013.01); *E04B 9/064* (2013.01); *E04B 9/24* (2013.01)

(58) Field of Classification Search

CPC . E04B 9/04; E04B 9/0428; E04B 9/06; E04B 9/064; E04B 9/065; E04B 9/067; E04B 9/24; E04B 9/247

USPC ..... 52/506.06, 506.07, 506.09

See application file for complete search history.

(56) References Cited

U.S. PATENT DOCUMENTS

| | | | | |
|---|---|---|---|---|
| 2,935,152 | A * | 5/1960 | Maccaferri | E04B 9/001 181/290 |
| 6,119,427 | A * | 9/2000 | Wyman | E04B 1/12 52/127.11 |
| 6,782,670 | B2 * | 8/2004 | Wendt | E04B 9/0478 52/311.1 |
| 7,621,090 | B2 * | 11/2009 | Kelley | E04B 9/003 52/506.07 |
| 8,096,089 | B2 * | 1/2012 | Platt | E04B 9/0414 52/316 |
| 8,578,673 | B2 * | 11/2013 | Kelly | E04B 9/122 52/220.6 |
| 8,739,488 | B2 * | 6/2014 | Vakhnin | E04B 9/068 52/506.06 |
| 9,376,813 | B2 * | 6/2016 | Bergman | E04B 9/0435 |
| 2003/0046892 | A1 * | 3/2003 | Albany | E04C 2/292 52/588.1 |
| 2005/0142369 | A1 * | 6/2005 | Canady | B32B 21/02 428/503 |
| 2006/0010812 | A1 * | 1/2006 | Jones | E04B 9/068 52/506.07 |
| 2006/0064939 | A1 * | 3/2006 | Kelley | E04B 9/003 52/506.07 |
| 2008/0229680 | A1 * | 9/2008 | Jahn | E04B 9/067 52/105 |

* cited by examiner

*Primary Examiner* — Phi D A

(74) *Attorney, Agent, or Firm* — Robert J. Yarbrough; Lipton, Weinberger & Husick

(57) ABSTRACT

A ceiling system for a clean room, a clean room ceiling and a method for constructing a ceiling for a clean room are provided. T-shaped beams support the ceiling from a building structure. Channels support composite panels on the bottom side of the T-shaped beams. Each of the channels is attached to the top side of a composite panel and each engages a first or second leg of a T-shaped beam. The channels may be Z-channels.

11 Claims, 18 Drawing Sheets

CLEAN ROOM CEILING, SYSTEM AND INSTALLATION METHOD

I. BACKGROUND OF THE INVENTION

A. Field of the Invention

The invention is a mounting system for a clean room ceiling, a clean room ceiling utilizing the mounting system and a method of installing a clean room ceiling utilizing the mounting system. The ceiling may be non-walkable. The ceiling of the Invention matches the appearance from inside the clean room of a more expensive walkable clean room ceiling and also presents a better opportunity for cleaning and disinfection compared to a conventional non-walkable clean room ceiling. The ceiling of the Invention provides for more flexible installation than prior art non-walkable clean room ceilings, with less opportunity for installation error and hence less opportunity for loss and waste.

B. Statement of the Related Art

Clean rooms are used to control the environment and prevent contamination of product, equipment, materials and processes in the pharmaceutical, biotechnology, life sciences and technology industries. A clean room may take the form of a building-within-a-building, with a clean room envelope within a larger building envelope. The larger building protects the clean room from the elements, contains mechanical systems serving the clean room and may provide structural support to the clean room. The clean room provides a discrete space in which the operator can separately control the temperature, humidity, cleanliness and air pressure.

A non-walkable clean room ceiling is not adequately robust to support adult human beings walking on the top of the non-walkable ceiling, but is adequate to segregate the clean room from the rest of the larger building. A non-walkable clean room ceiling may require catwalks or scaffolding to allow human operators to access mechanical systems on the top of the clean room or to access the clean room structure itself. Conversely, a walkable-ceiling clean room system will support human beings walking upon the top of the ceiling. The non-walkable ceiling has the advantage of significantly reduced cost compared to a walkable ceiling.

Clean rooms may utilize ceiling panels having a composite construction, with each composite panel composed of opposing steel skins bonded to a crenelated aluminum core. For reduced weight and cost, the composite panels are constructed to be as thin as possible, consistent with the structural requirements of the ceiling. For a non-walkable clean room ceiling, the thickness of the composite panels generally is less than one inch.

Prior art non-walkable clean room ceilings are supported in a manner similar to the familiar suspended ceiling; namely, a grid of T-shaped beams hangs from the larger building structure and ceiling panels are supported at their periphery by the top of the T-shaped beams.

The prior art non-walkable clean room ceilings present disadvantages. First, the intersection of each ceiling panel and each T-shaped beam presents a raised discontinuity where biological contaminants, such as microorganisms, may find refuge and have a better chance of surviving chemical cleaners and disinfectants. Second, the bottom portion of each T-shaped beam is readily visible from inside the clean room, identifying the ceiling as a less expensive and less sophisticated non-walkable ceiling. Third, the intersection between each adjacent pair of composite panels presents two raised discontinuities corresponding to each side of the T-shaped beam, compared to the intersection of two adjacent ceiling panels of a walkable ceiling, which can present a single shallow groove.

II. SUMMARY OF THE INVENTION

The invention is a mounting system for a clean room ceiling, which may be a non-walkable clean room ceiling, a clean room ceiling utilizing the mounting system and a method of installing a clean room ceiling utilizing the mounting system.

In the mounting system and clean room of the invention, a grid of T-shaped beams is suspended from the structure of a larger building. Each T-shaped beam includes an upright portion and opposing horizontal legs. The opposing horizontal legs in combination define a bottom side of the T-shaped beam. Composite panels are attached to the bottom side of the grid of T-shaped beams so that the edges of the composite panels adjoin and so that the composite panels in combination define a substantially continuous ceiling surface as viewed by an observer inside the clean room. The T-shaped beam is completely covered by the composite panels and the T-shaped beams do not present raised discontinuities inside the clean room. The junction between adjacent composite panels is substantially smooth and flush. A person inside the clean room perceives the junction between composite panels as a single shallow groove.

Because of the lack of raised discontinuities in the clean room ceiling, the mounting system of the invention results in a clean room ceiling that is easier to disinfect and that is more secure from biological contamination. The clean room ceiling also has the appearance from inside the clean room of a more expensive walkable clean room ceiling.

The top side of the composite panel may be attached to the T-shaped beams in any of several different means. For example, a channel may connect the composite panel to the T-shaped beam. The channel is attached to the top side of the composite panel. The channel defines a slot. A leg of the T-shaped beam is disposed within the slot and engages the channel. The leg of the T-shaped beam supports the channel and the channel supports the composite panel. The use of a channel defining a slot allows for float, or movement, in the location of the composite panel during installation, easing the task of installation and reducing the chances for error and waste during installation.

Fasteners or any other suitable attachment mechanism attach the channel to the composite panel. The fastener may comprise screws, rivets, staples, pins, adhesives, spring clips, thermal or chemical welding, soldering, brazing, or any other suitable fastener. As used in this document, the term 'fastener' means any mechanism known in the art to mechanically attach one object to another.

The channel may be a Z-channel. Each Z-channel features a first horizontal portion, a vertical portion and a second horizontal portion. The first horizontal portion is adequately wide to allow fasteners to join the first horizontal portion to the skin or core of the composite panel. The height of the vertical portion corresponds to the thickness of a leg of the T-shaped beam. The width of the second horizontal portion is adequate to engage the leg of the T-shaped beam. The Z-channel may be composed of steel, aluminum, a polymer, or any other material that may be attached to the top side of the composite panel and that has adequate strength to support the ceiling panel.

The Z-channel may extend substantially the length of a first edge of the composite panel. The use of the Z-channels along a first edge eases installation, allowing a single installer to install the composite panel to the T-shaped beams. The use of the Z-channel also hides the T-shaped beam, halves the number of junctions between ceiling components and allows adjacent ceiling components to be flush.

An elongated Z-channel is only one of multiple channel configurations that may support the composite panel from the leg of a T-shaped beam. The channel and slot may be defined by two or more shorter Z-channels in combination. The plurality of shorter Z-channels are separately attached to the top side of the composite panel and in combination engage the leg to the T-shaped beam and support the composite panel. Alternatively, the channel may not be a Z-channel and may have any other configuration that defines a slot when attached to the top side of the composite panel. As another alternative, the channel may define a slot only when the channel is in engagement with the leg of the T-shaped beam. For each embodiment, the channel may be composed of multiple smaller channels that, in combination, define a slot.

The channel and slot may be defined by a plurality of C-clips, with each of the C-clips attached to the composite panel. The top skin of the composite panel may define a plurality of openings corresponding to a location of the leg of the T-shaped beam. One arm of each C-clip may penetrate one of the plurality of openings, so that one arm of each C-clip is disposed between the top skin and the crenelated aluminum core of the composite panel. The engagement between the arm of the C-clip and the skin of the composite panel secures the C-clip to the composite panel.

As another alternative, the top skin of the composite panel may define the channel and slot. In this alternative, the top skin of the composite panel defines a plurality of tabs. An installer may separate each tab from the aluminum core of the composite panel to allow a leg of the T-shaped beam to fit between the tab and the remainder of the top skin. The installer may bend the tab to retain the tab, and hence the composite panel, to the bottom side of the T-shaped beam. The tabs alone may be sufficient to support the composite panel; however, to prevent the tab from disengaging from the T-shaped beam, the upright portion of the T-shaped beam may feature holes penetrating the upright portion. The installer may install pins through the hole penetrating the upright portion of the T-shaped beam. The pins prevent the tabs from deforming and releasing the legs of the T-shaped beam. As an alternative to pins, the installer may place one or more spring clips over the upright portion of the T-shaped beam. The spring clip prevents the tab from disengaging from the leg of the T-shaped beam.

Alternatives to the channels and slots described above may attach the composite panel to the bottom side of the T-shaped beam. For example, a plurality of spring pins may be disposed on the periphery of the top side of the composite panel. The location of each of the plurality of spring pins corresponds to the location of a pin-receiving slot in the corresponding leg of the T-shaped beam. Retention springs on the spring pins prevent the spring pins from unintentionally disengaging from the T-shaped beam. The long dimension of the pin-receiving slots may be parallel or transverse to the long dimension of the T-shaped beam to allow float in the installed composite panel. This alternative also allows the composite panel to be installed by one person from below.

As another alternative to the use of a channel, a curved spring may be disposed on the top skin of the composite panel proximal to the edge of the panel. The curved spring is configured so that when the composite panel is placed in engagement with the opposing T-shaped beams from below, a steeply curved portion of the curved spring engages the end of the leg of the T-shaped beam. Because of the steep curve, when the installer presses upward on the composite panel in the location of the curved spring, the leg of the T-shaped beam urges the curved spring laterally. When the widest portion of the curved spring clears the leg of the T-shaped beam, the spring tension returns the spring to its starting position and urges the composite panel against the bottom side of the T-shaped beam. This alternative also allows the composite panels to be snapped into place from below by a single installer.

In the method of the Invention, an installer will engage a slot defined by a channel on the top side of a composite panel to the corresponding leg of a first T-shaped beam, with the composite panel disposed on the bottom side of the first T-shaped beam. The engagement between the leg of the first T-shaped beam and the slot supports the composite panel below the first T-shaped beam. The installer then will place the top side of the composite panel in engagement with the bottom side of an opposing second T-shaped beam. The installer places one or more channels on top of the composite panel in engagement with the top side of a leg of the second T-shaped beam. The installer then attaches the channel to the top side of the composite panel. The first and second channels in cooperation secure the composite panel to the first and second T-shaped beams.

If other T-shaped beams intersect the top surface of the composite panel, as where the T-shaped beams are configured as a rectangular lattice, then other channels may be disposed on the top side of the composite panel to secure the composite panel to the other T-shaped beams.

While the edges of the composite panel may be parallel to the longitudinal axis of opposing T-shaped beams, other orientations of the composite panel are contemplated by the invention. For example, the composite panel may be secured to the T-shaped beams so that the edges of the composite panel are oblique to the longitudinal axes of the T-shaped beams. In addition, the T-shaped beam lattice is not required to be rectangular and may be of any shape, for example a parallelogram or irregular shape. The system of the invention therefore provides substantial flexibility in orienting and securing the composite panels to define the ceiling. The use of the Z-channels also allows for float in the location of the composite panels with respect to the T-shaped beams and provides adjustability of the location of adjoining panels.

Any of the above alternatives may be combined with any other alternative. For example, one side of a composite panel may be equipped with a fixed Z-channel attached by fasteners, while the other sides of the panel may be equipped with a curved flat spring.

III. SUMMARY OF THE DRAWINGS

IV. DESCRIPTION OF AN EMBODIMENT

The invention is a clean room ceiling system, a clean room ceiling 2 constructed using the system of the invention, and a method of constructing a clean room ceiling 2.

Figure 1:
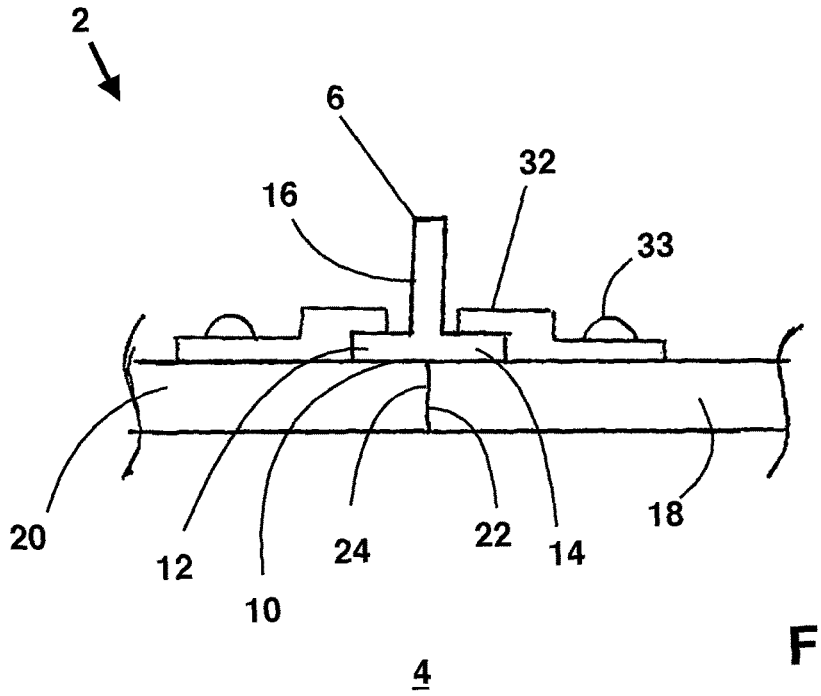
FIG. 1 is a detail end view of a clean room ceiling utilizing Z-channels.
Figure 2:
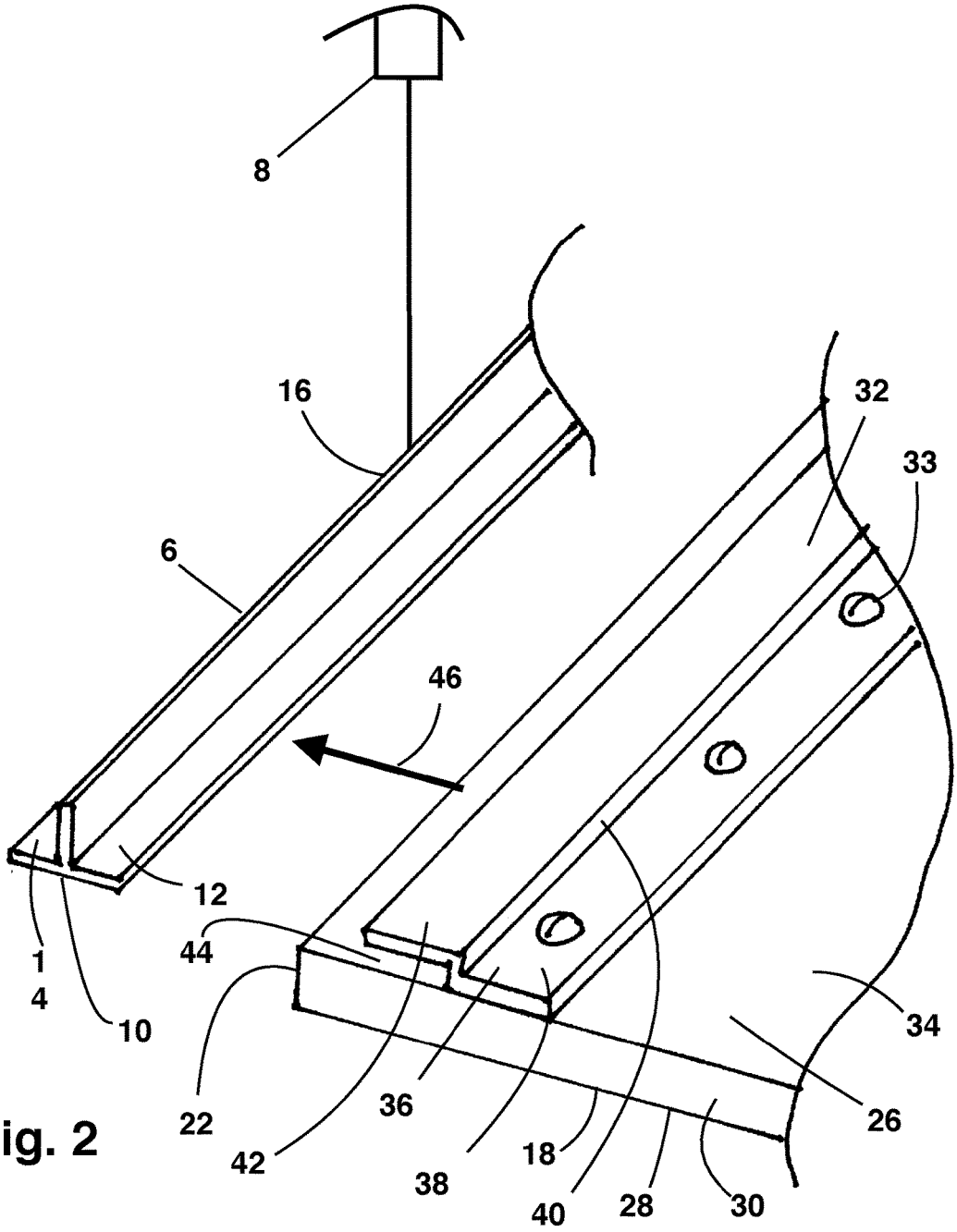
FIG. 2 is a perspective exploded view of a T-shaped beam and composite panel with a Z-channel attached.

In each of the embodiments described in this document, T-shaped beams 6 are suspended from the building structure 8 and support the remainder of the clean room ceiling 2. FIGS. 1-4 illustrate a first embodiment of the system and ceiling 2 of the invention. FIG. 1 is a detail end view of a first embodiment. A first T-shaped beam 6 is one of plurality of T-shaped beams 6 that are suspended from the building structure 8 (as shown by FIG. 2). The T-shaped beams 6 support the remainder of the ceiling 2.

As shown by FIGS. 1 and 2, the T-shaped beam 6 has a bottom side 10, a first leg 12 and a second leg 14. The first leg 12 and second leg 14 in combination define the bottom side 10 of the T-shaped beam 6. The T-shaped beam 6 has an upright portion 16 and extends upward from the first and second legs 12, 14.

From FIG. 1, a first composite panel 18 and a second composite panel 20 are disposed on the bottom side 10 of the T-shaped beam 6. The first composite panel 18 has a first edge 22. The second composite panel 22 has a second edge 24. The first and second edges 22, 24 are located so that the edges 22, 24 are immediately adjacent one to the other.

The first and second composite panels 18, 20 include a top skin 26, an opposing bottom skin 28 and a core 30, shown by FIG. 2. The top and bottom skins 26, 28 may be composed of any suitably strong, smooth and durable material known in the art, such as sheet steel. The core 30 may be composed of crenelated aluminum or any other suitable material that is attached to the opposing skins 26, 28 by any suitable technique, such as bonding, chemical or thermal welding, or brazing.

From FIGS. 1 and 2, a first channel 32 is attached to the to first panel top side 34. In the embodiment of FIGS. 1 and 2, the first channel 32 is attached to the panel top side 34 by fasteners 33, such as screws, pins, rivets, adhesives, welding, brazing, clips, springs, or any other technique for attaching one structure to another.

In the embodiment of FIGS. 1 and 2, the first channel 32 is a first Z-channel 36. The first Z-channel defines a first horizontal portion 38, a vertical portion 40 and a second horizontal portion 42. The first horizontal portion 38 is configured for attachment to the panel top side 34 by fasteners 33. For example, if the first Z-channel 36 is to be attached to the panel top side 34 by screws, the first horizontal portion 38 may feature holes for the screws. If the first Z-channel is to be attached to the panel top side 34 by bonding, the first horizontal portion 38 will be wide enough to provide a bonded connection of adequate strength.

From FIG. 2, the vertical portion 40 of the first Z-channel 36, the second horizontal portion 42 and the composite panel top side 34, in combination, define a first slot 44. The first slot 44 is configured to receive the first leg 12 of the T-shaped beam 6 when the first composite panel 18 is moved in the direction of arrow 46. When the first slot 44 receives the first leg 12, the second horizontal portion 42 of the Z-channel 36 engages the first leg top side 47, by which the first leg 12, and hence the T-shaped beam 6 supports the first composite panel 18 proximal to the first edge 22. Other T-shaped beams 6 similarly support other portions of the first composite panel 18.

FIG. 2 illustrates that the channel 32 may be attached to the first composite panel 26 prior to the step of placing the composite panel top side 34 in engagement with the T-shaped beam 6. Alternatively, the composite panel 18, 20 may be placed in engagement with the bottom side 10 of one or more T-shaped beam 6 and the channel 32 placed on and attached to the top side 34 of the composite panel 18, 20 so that the channel 32 traps the first or second leg 12, 14 of the T-shaped beam 6. The T-shaped beam 6 thus supports the composite panel 18, 20.

Figure 3:
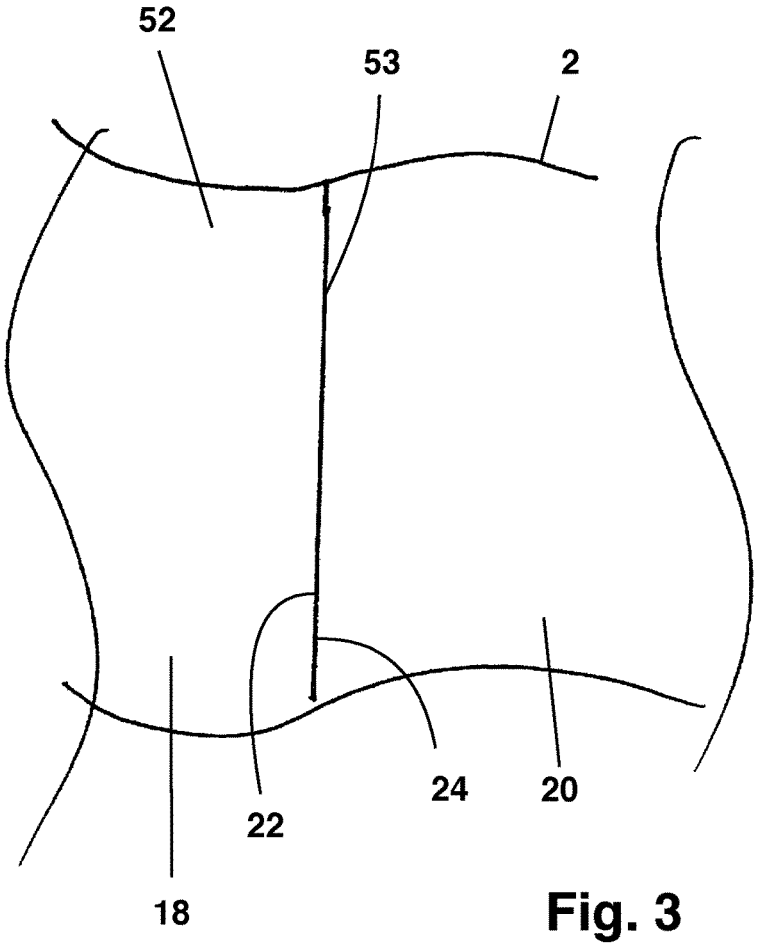
FIG. 3 is a plan view of the bottom side of the clean room ceiling as seen by an observer located inside the clean room.

FIG. 3 is a detail bottom view of the clean room ceiling 2 that is visible to an observer located inside the clean room 4. The observer sees the visible clean room ceiling 52 comprising the bottom side of the first and second composite panels 18, 20. The observer can see the smooth, flush bottom sides of the first and second composite panels 18, 20. The observer also can see the junction 53 between the first edge 22 and the second edge 24 of the first and second composite panels 18, 20. The junction 53 appears as a shallow groove. The observer does not see the T-shaped beams 6 because those beams are hidden by the composite panels 18, 20.

Figure 4:
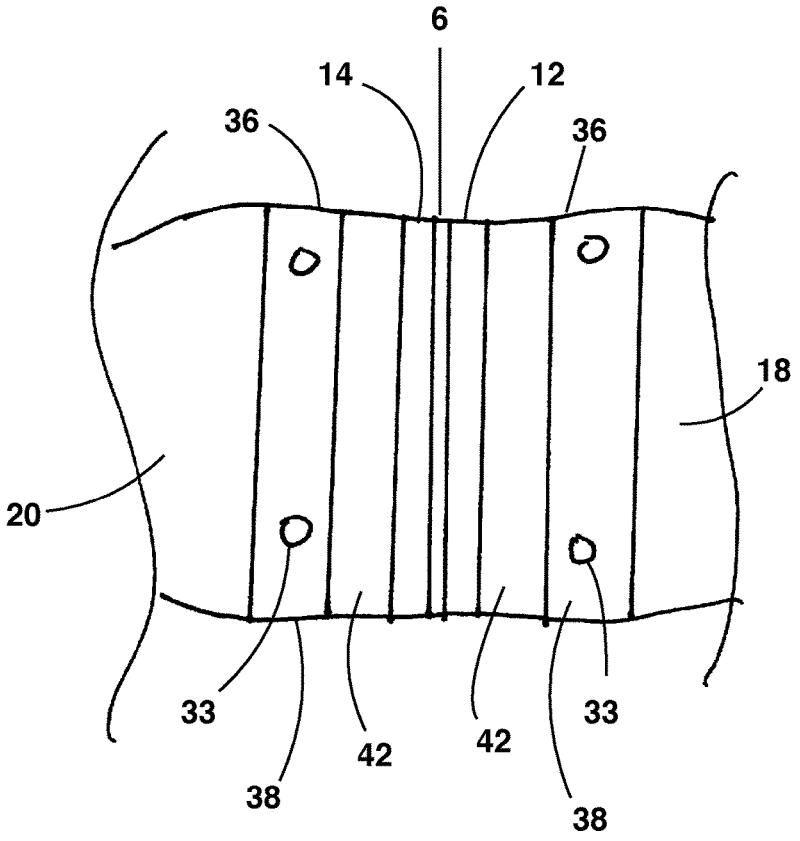
FIG. 4 is a detail plan view of the top side of the clean room ceiling utilizing Z-channels.

FIG. 4 is a detail plan view of the top side of the clean room ceiling 2 that utilizes Z-channels 36. In the detail plan view of FIG. 4, a single Z-channel 36 is attached to the first composite panel 18 by fasteners 33 and engages the first leg 12 of the T-shaped beam 6. A single Z-channel 36 is attached to the second composite panel 20 by fasteners 33 and engages the second leg 14.

Figure 5:
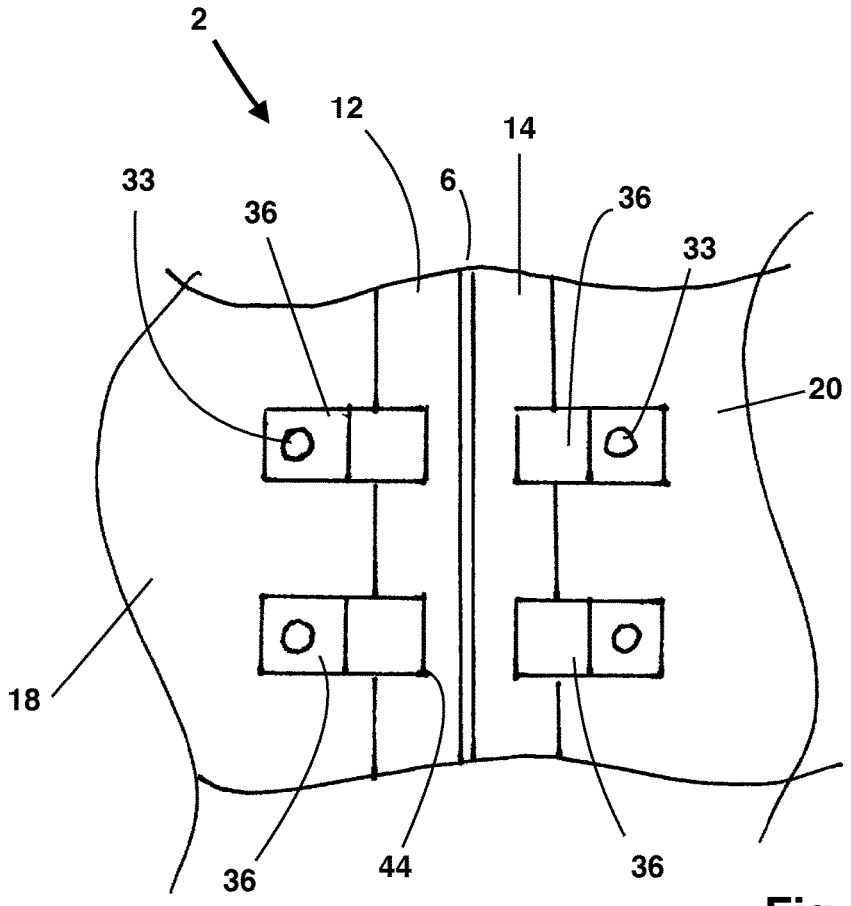
FIG. 5 is a detail plan view of the top side of the clean room ceiling where each Z-channel is a plurality of Z-channels.

FIG. 5 illustrates a second embodiment and is a detail plan view of the top side of the clean room ceiling 2 that uses Z-channels 36. FIG. 5 is the same view as FIG. 4, except that FIG. 5 illustrates that the Z-channel 36 may comprise a plurality of Z-channels 36, with the plurality of Z-channels 36 in combination defining the first slot 44. The plurality of Z-channels 36 engage either the first leg 12 of the T-shaped beam 6, for the first composite panel 18, or the second leg 14 of the T-shaped beam 6, for the second composite panel 14, and thereby support the composite panels 18, 20 from the T-shaped beam 6.

Figure 6:
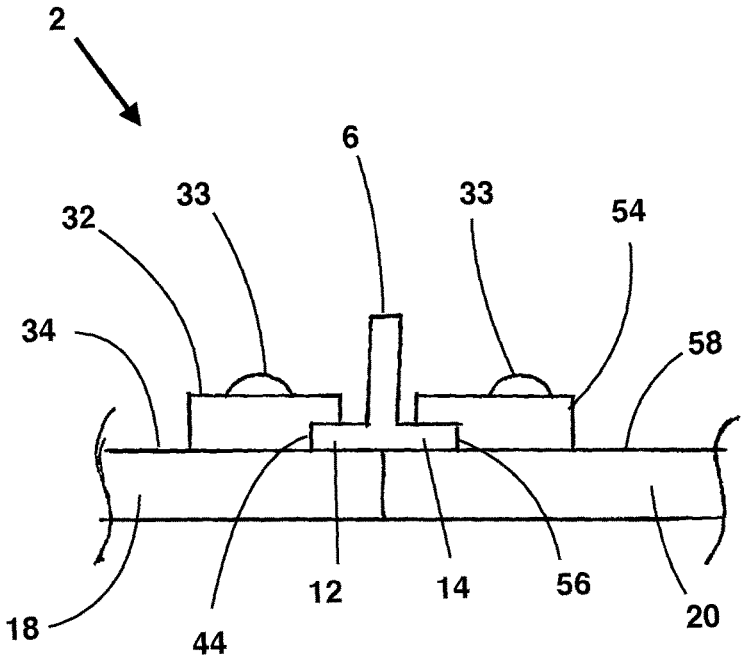
FIG. 6 is a detail end view of the clean room ceiling utilizing a channel.
Figure 7:
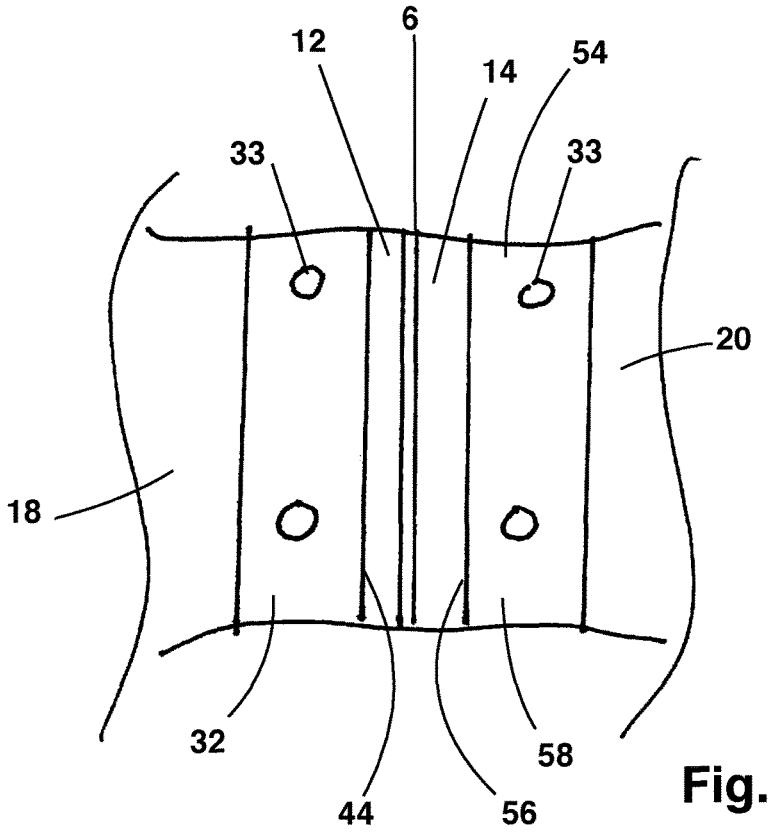
FIG. 7 is a detail plan view of the top side of the clean room ceiling of FIG. 6.
Figure 8:
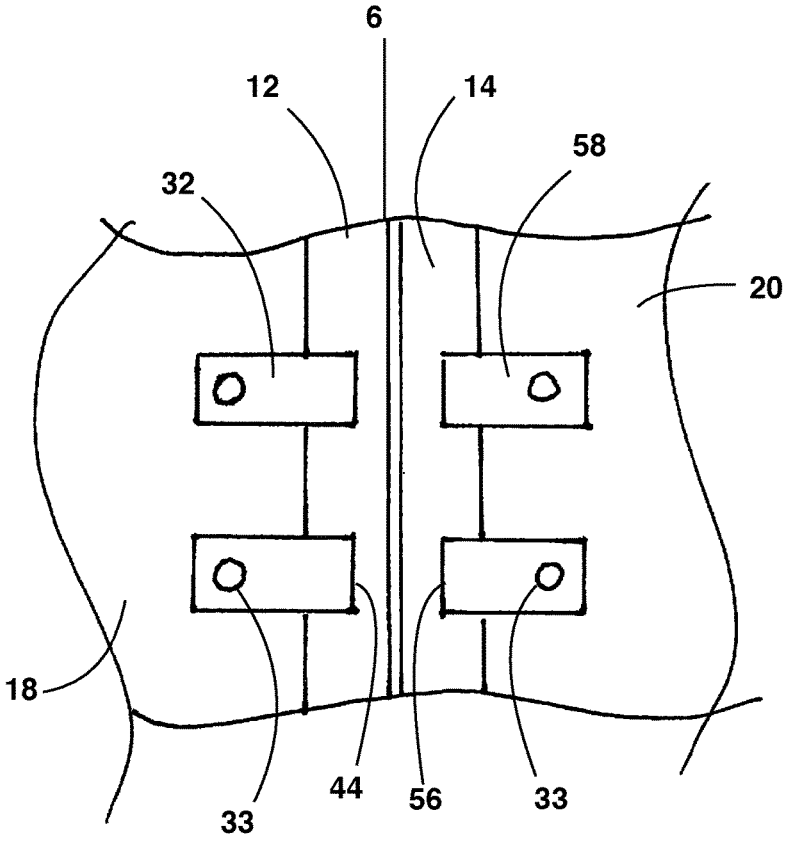
FIG. 8 is a detail plan view of the top side of the clean room ceiling of FIG. 6 where the channel is a plurality of channels.

FIGS. 6 through 8 illustrate a third embodiment. FIG. 6 is a detail side view of the clean room ceiling 2. The channels 32 of FIG. 6 are not Z-channels 36, but the first channel 34 defines a first slot 44 in combination with the top side 34 of the first composite panel 18. A second channel 54 similarly defines a second slot 56 In combination with the top side 58 of the second composite panel 20. First channel 32 and second channel 58 are attached to the composite panels 18, 20 by fasteners 33.

As illustrated by FIG. 7, the channels 32, 58 may comprise a single channel 32, 58. As illustrated by FIG. 8, the channels 32, 58 may comprise multiple channels 32, 58 that in combination define first and second slots 44, 58.

Figure 9:
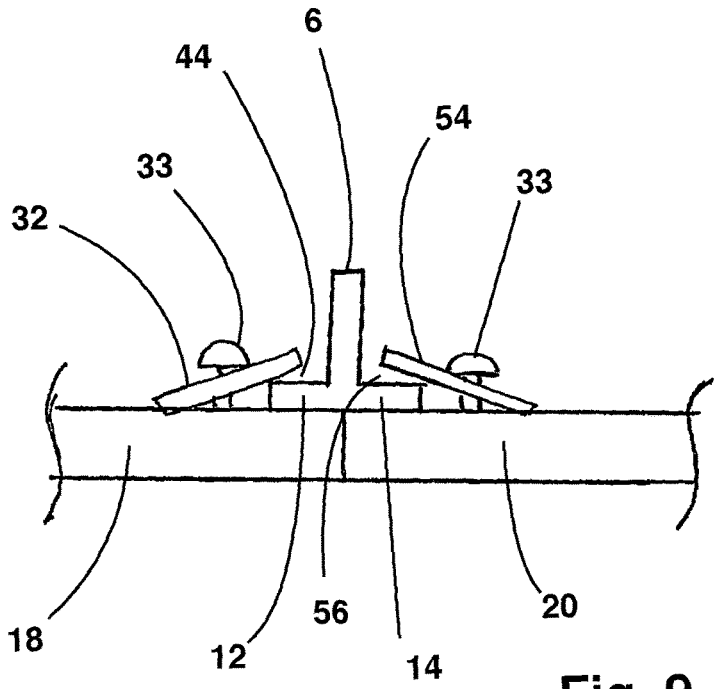
FIG. 9 is a detail end view of a clean room ceiling utilizing a second embodiment of a channel.
Figure 10:
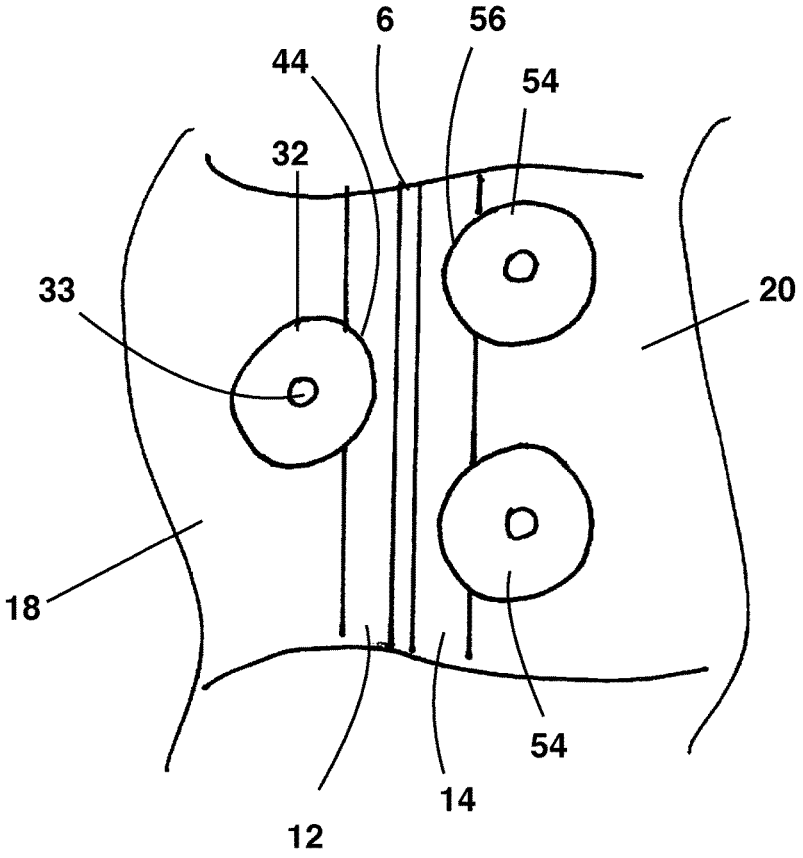
FIG. 10 is a detail plan view of the top side of the ceiling of FIG. 9 where the second embodiment of a channel comprises a plurality of second embodiment channels.

FIGS. 9 and 10 show a fourth embodiment. In the embodiment of FIGS. 9 and 10, the channels 32, 54 define first and second slots 44, 56 when the channels 32, 54 engage the first and second legs 12, 14 of the T-shaped beam 6, but not otherwise. FIG. 10 shows an example configuration of the channels 32, 54 of this fourth embodiment. In the embodiment of FIG. 10, the channels 32, 54 are in the shape of a plurality of circular washers. The plurality of channels 32, 54 may be of any shape and are not necessarily circular. Alternatively, the channels 32, 54 of this fourth embodiment may have a single elongated configuration, as shown by FIG. 7.

Figure 11:
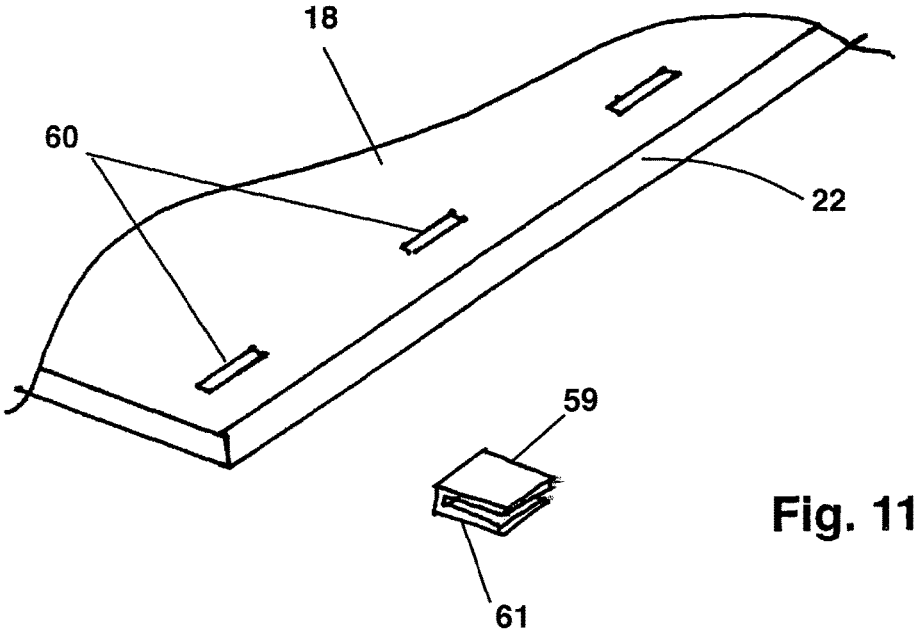
FIG. 11 is an exploded detail perspective view of a composite panel and C-clip utilizing openings in the composite panel.
Figure 12:
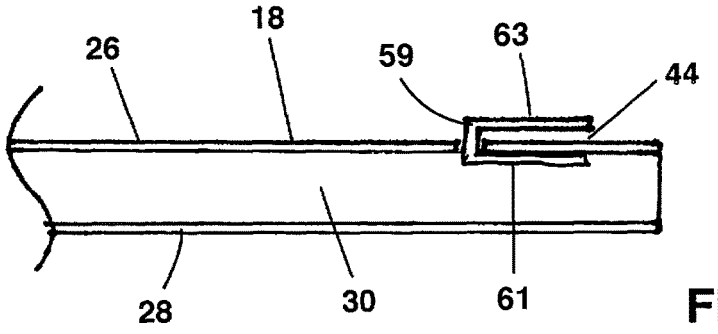
FIG. 12 is a detail section view of the composite panel of FIG. 11 with the C-clip installed.

FIGS. 11 and 12 illustrate a fifth embodiment. The fifth embodiment utilizes multiple C-clips 59. The first composite panel 18 includes a corresponding plurality of openings 60 defined by the first composite panel top skin 26. The first horizontal portion 61 of each C-clip 59 is inserted through the opening 60 and extends between the top skin 26 and the core 30 of the composite panel 18, 20. The second horizontal portion 63 in combination with the first panel top side 34 defines the first slot 44. The first slot 44 receives the first leg of the T-shaped beam to support the first composite panel 18. The second panel 20 also may feature the openings 60 and receive the C-clips 59.

Figure 13:
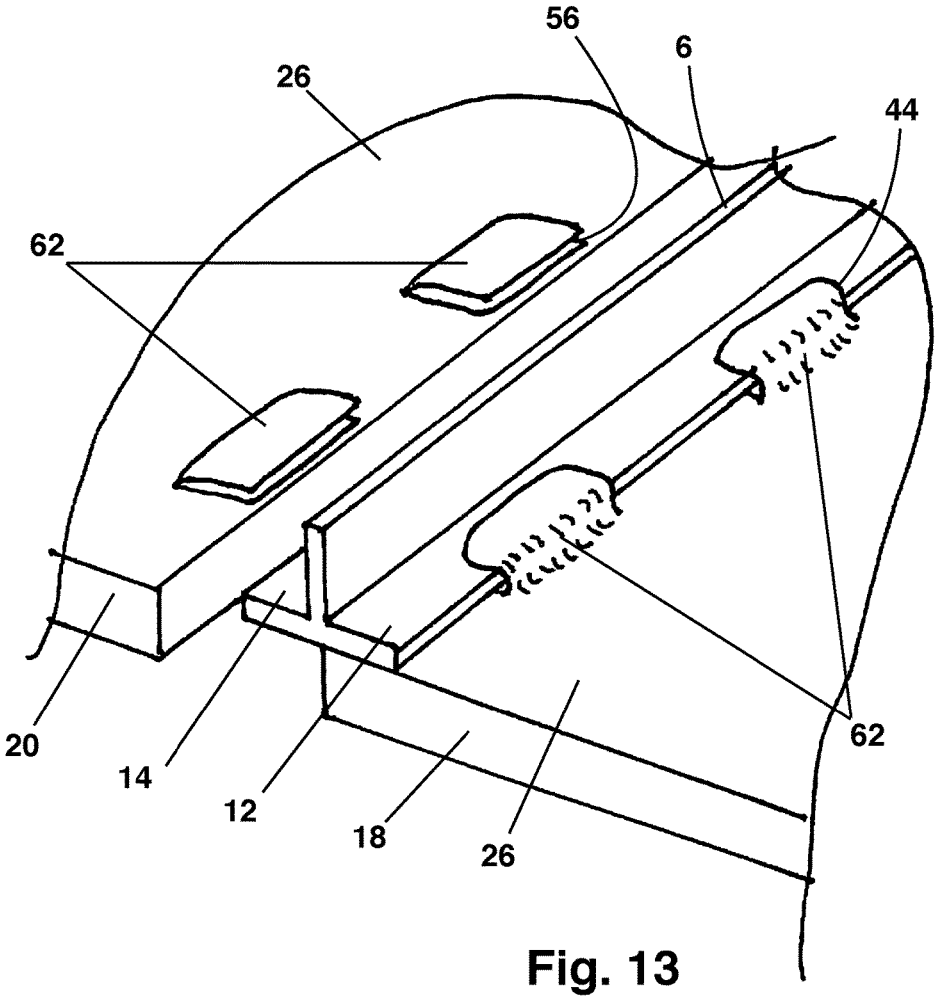
FIG. 13 is a detail exploded perspective view of a clean room ceiling utilizing tabs.
Figure 14:
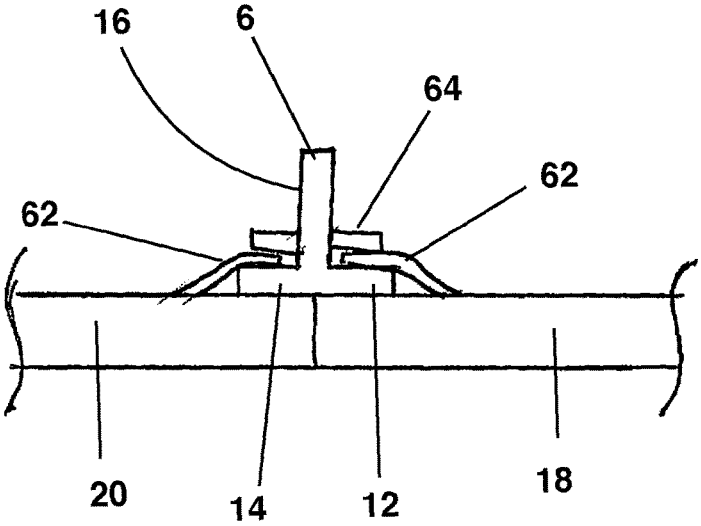
FIG. 14 is a detail end view of the ceiling of FIG. 14 using pins to retain the tabs.
Figure 15:
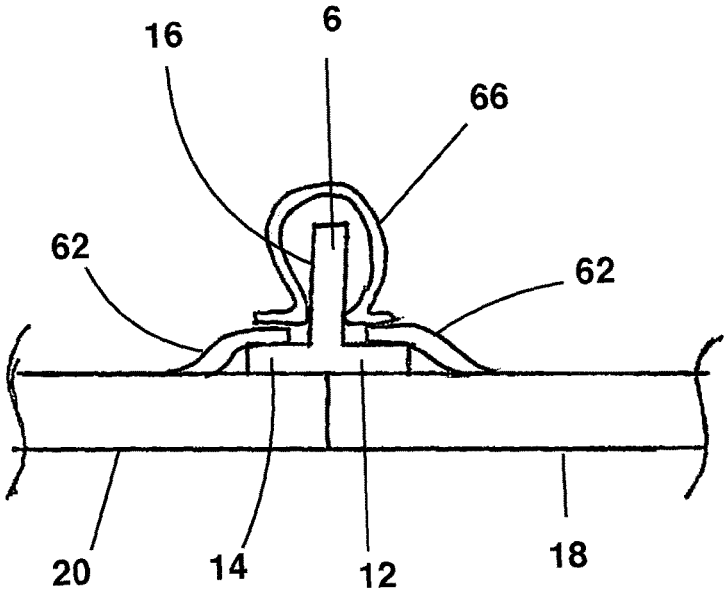
FIG. 15 is a detail end view of the ceiling of FIG. 14 using a spring clip to retain the tabs.

FIGS. 13 through 15 illustrate a sixth embodiment. In the sixth embodiment, tabs 62 are defined by the top skin 26 of the composite panels 18, 20. The tabs 62 define the first slot 44 and the second slot 56. FIG. 13 is a detail perspective view of the sixth embodiment. In FIG. 13, the first composite panel 18 is attached to the first leg 12 of the T-shaped beam 6 by engaging the first leg 12 with the first slot 44. FIG. 13 shows the tabs 62 of the second composite panel 20 not in engagement with the second leg 14 of the T-shaped beam 6 to more clearly show the tab 62.

FIGS. 14 and 15 demonstrate two apparatus to prevent release by the tabs 62 of FIG. 13 from the T-shaped beam 6. FIG. 1 is an end view showing the tabs 62 engaging the first and second legs 12, 14 of the T-shaped beam 6. A pin 64 penetrates a hole defined by the upright portion 16 of the T-shaped beam 6, reinforcing the tabs 62. FIG. 15 illustrates a spring clip 66 to reinforce the tabs 62 rather than a pin 64. The spring clip 66 resiliently engages the upright portion 16 of the T-shaped beam 6, reducing any tendency of the tabs 62 to release from the first or second legs 12, 14 of the T-shaped beam 6.

Figure 16:
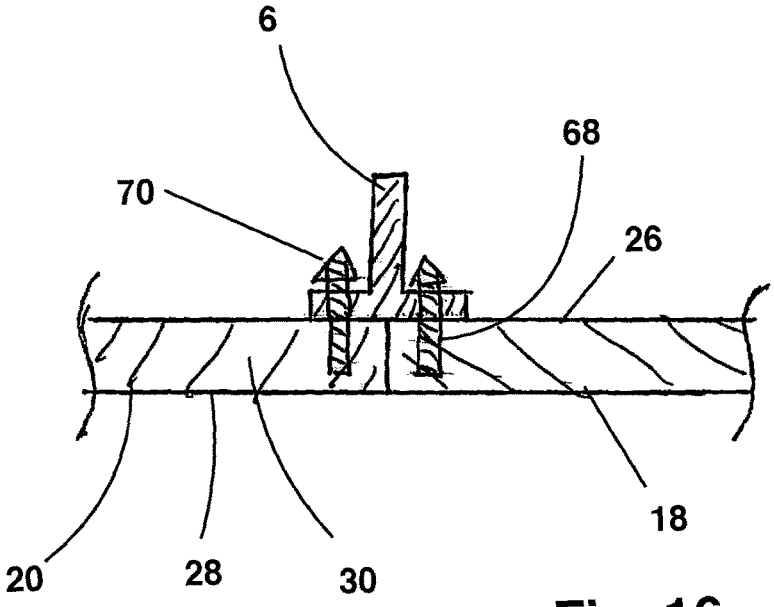
FIG. 16 is a detail sectional end view of a clean room ceiling utilizing spring pins to retain the composite panels to the T-shaped beams.

FIG. 16 shows a seventh embodiment. Each of the composite panels 18, 20 includes a plurality of latching pins 68 that extend from the top side 34, 58 of the composite panel 18, 20 at the location of the legs 12, 14 of the T-shaped beam 6. The latching pins 68 may be attached to any or all of the core 30, bottom skin 28 and top skin 26. To install the composite panels 18, 20 to the T-shaped beam 6, the latching pins 68 are inserted through holes or slots defined by the first or second legs 12, 14 of the T-shaped beam 6. An expanding top 70 of the latching pin 68 resists pullout of the latching pin 68 from the hole or slot.

Figure 17:
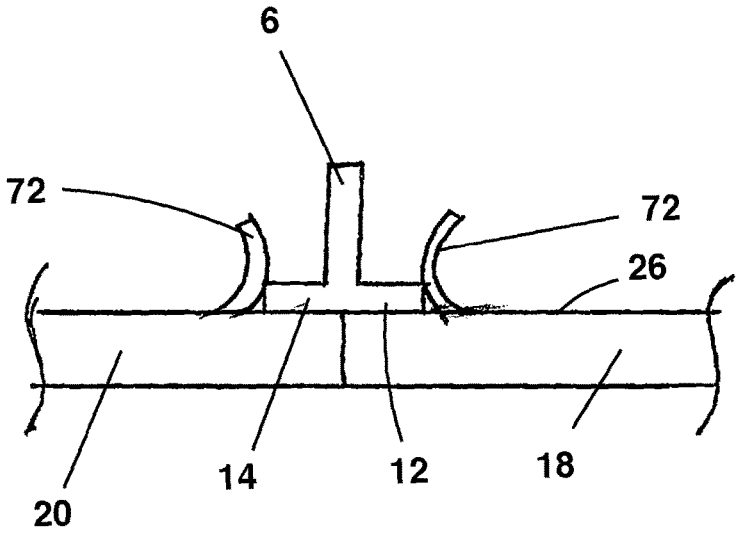
FIG. 17 is a detail end view of a clean room ceiling utilizing flat springs to retain the composite panels to the T-shaped beams.

FIG. 17 shows an eighth embodiment. In the embodiment of FIG. 17, flat springs 72 extend from the top side of the composite panels 18, 20. The flat springs 72 may be defined by the top skin 26 of the panels 18, 20, or may be attached to the top skin 26. The flat springs 72 are curved so that the composite panel 18, 20 can be pressed into engagement with the T-shaped beam 6 from below. Flat springs 72 mounted in opposing directions on a composite panel 18, 20 clamp the panel 18, 20 between opposing T-shaped beams 6, with the top side 34 of the composite panel 34 engaging the bottom side 10 of the T-shaped beam 6.

Figure 18:
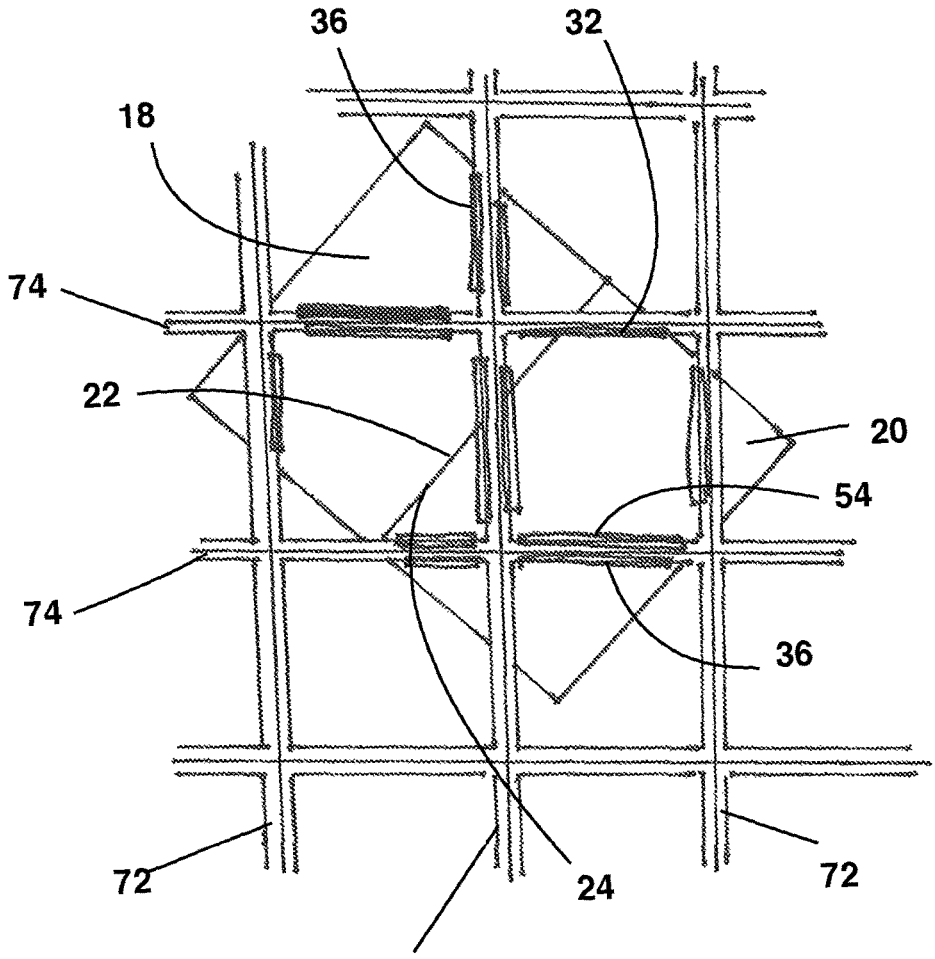
FIG. 18 is a plan view from above of a grid of T-shaped beams.

While the edges 22, 24 of the composite panels 18, 20 may be aligned with the T-shaped beams 6 as shown by FIGS. 1, 2, and 4-17, FIG. 18 illustrates that alignment of the composite panels 18, 20 and the T-shaped beams 6 is not required. FIG. 18 is a plan view from above of a grid of T-shaped beams 6, including second T-shaped beams 72 opposing the first T-shaped beam 6 and third T-shaped beams 74 orthogonal to the first and second T-shaped beams 6, 72. In the example of FIG. 18, the composite panels 18, 20 are mounted oblique to the grid of first, second and third T-shaped beams 6, 72, 74. The composite panels 18, 20 are attached to the T-shaped beams 6, 72, 74 by a plurality of first channels 32, second channels 54 and third channels 76. The channels 32, 54, 76 may be Z-channels 36. As described above, the top side 34 of the composite panels 18, 20 engages the bottom side 10 of the T-shaped beams 6, 72, 74.

Figure 19:
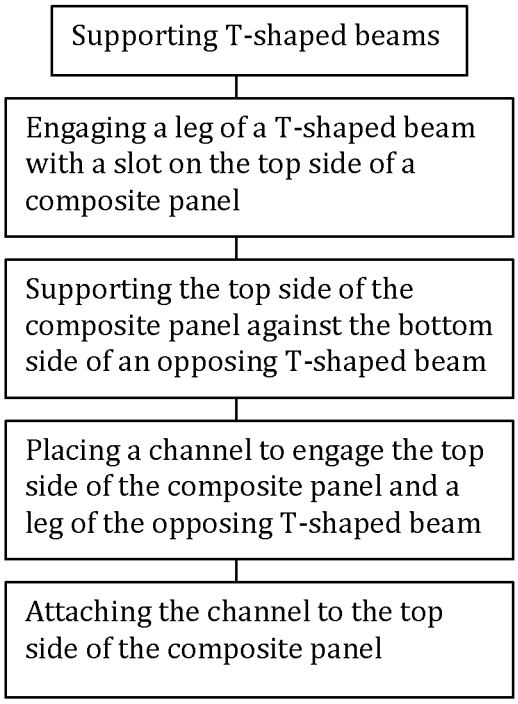
FIG. 19 is a flow chart of a method of the Invention.

The flow chart of FIG. 19 illustrates a method of the Invention. As shown by FIG. 18, an installer supports opposing T-shaped beams 6 from the structure 8 of a building, as by cables or rods. Each of the T-shaped beams 6 has a first leg 12 and a second leg 14. The first and second legs 12, 14 together define the bottom side 10 of the T-shaped beams 6. The top side 34 of the composite panel 18 defines a slot 44, as discussed above. The installer engages the slot 44 with one of the legs 22, 24 of a first T-shaped beam 6. The installer supports the composite panel 18 against the bottom side 10 of the T-shaped beams 6. The installer places a channel 32 in engagement with the top side 34 of the composite panel 18 and one of the legs 12, 14 of the opposing second T-shaped beam 6. The installer then attaches the channel 32 to the top side 34 of the composite panel 18, thus attaching the composite panel 18 to the bottom side 10 of the opposing T-shaped beams 6. As noted, additional channels 32 may be used to attach the top side 34 of the composite panel 18 to the bottom sides 10 of other T-shaped beams 6. When adjoining composite panels 18, 20 are attached to the opposing T-shaped beams 6, corresponding edges 22, 24 of the adjoining composite panels 18, 20 meet, covering the bottom side 10 of the T-shaped beams band rendering the T-shaped beams 6 not visible to a person located within the clean room 4.

The following is a list of numbered elements from the drawings.

Ceiling system 2
Clean room 4
T-shaped beam 6
Building structure 8
Bottom side of the T-shaped beam 10
First leg of the T-shaped beam 12
Second leg of the T-shaped beam 14
Upright portion of the T-shaped beam 16
First composite panel 18
Second composite panel 20
First edge of the first composite panel 22
Second edge of the second composite panel 24
Top skin 26

Bottom skin 28
Core 30
First channel 32
Fastener 33
First panel top side 34
Z-channel 36
First horizontal portion of the Z-channel 38
Vertical portion of the Z-channel 40
Second horizontal portion of the Z-channel 42
A first slot 44
Arrow 46
First leg top side 47
First panel bottom side 48
Second panel bottom side 50
Visible clean room ceiling 52
A plurality of first Z-channels
A second channel 54
A second slot 56
A second panel top side 58
A C-clip 59
A plurality of openings in the first composite panel top side 60
A C-clip first horizontal surface 61
A tab 62
A C-clip second horizontal surface 63
A pin 64
Spring clip 66
latching pin 68
expanding top 70
flat spring 72
A second T-shaped beam 72
A third T-shaped beam 74
A third channel 76

We claim:

1. A ceiling system for a clean room, the system comprising:

a) a first T-shaped beam, said first T-shaped beam having a bottom side defining a first leg;

b) a plurality of channels, each of said channels having a first horizontal portion and a second horizontal portion, said second horizontal portion being configured to selectably engage and to be supported by said first leg of said T-shaped beam, said second horizontal portion being configured to support said first horizontal portion;

c) a first composite panel, said first composite panel having opposing top and bottom skins in a spaced-apart relation and a core disposed between and attached to said top and bottom skins, said top and bottom skins being composed of steel, wherein said first composite panel top skin defining a plurality of openings communicating through said top skin, each of said openings being configured to selectably receive said first horizontal portion of a one of said plurality of channels so that said channel penetrates said opening and said first horizontal portion is disposed between said top skin and said core, whereby an engagement between said first horizontal portion of said plurality of channels and said top skin of said first composite panel selectably attaches said first composite panel to said first leg of said T-shaped beam.

2. A method of constructing a ceiling for a clean room, the method comprising the steps of:

a) supporting a first and a second T-shaped beam from a building structure, said first and second T-shaped beams being straight and not parallel, each of said first and second T-shaped beams defining a first leg, said first legs defining a bottom side of said first and second T-shaped beams, said bottom side of said first T-shaped beam and said bottom side of said second T-shaped beam in cooperation defining a ceiling plane, said ceiling plane being mathematical and not being a physical object;

b) providing a first composite panel, said first composite panel having a first edge and a top side, said first composite panel having a top skin and a bottom skin and a core disposed between and attached to said top and bottom skins, said top and bottom skins being composed of steel, said top and bottom skins being in spaced-apart relation, said top skin defining a plurality of openings communicating through said top skin, said plurality of openings corresponding to said first leg of said first T-shaped beam and said second leg of said second T-shaped beam;

c) providing a plurality of channels, each of said plurality of channels having a first horizontal portion and a second horizontal portion, said second horizontal portion being configured to support said first horizontal portion;

d) placing said top side of said first composite panel in engagement with said bottom side of said first T-shaped beam and said second T-shaped beam so that said top side of said first composite panel is coincident with said mathematical ceiling plane;

e) inserting said first horizontal portions of said channels through said openings in said top skin of said first composite panel so that said channels penetrate said openings and said first horizontal portions are disposed between said top skin and said core;

f) placing said second horizontal portions of said channels in engagement with said first leg of said first T-shaped beam or said second leg of said second T-shaped beam, whereby said second horizontal portions of said channels are supported by said first and second T-shaped beams and said first horizontal portions of said channels support said first composite panel.

3. The ceiling system of claim 1 wherein said channel is a Z-channel.

4. The ceiling system of claim 1 wherein said channel is a C-clip.

5. The ceiling system of claim 1, further comprising:

a second composite panel, said second composite panel having a second edge, said core, and said top and bottom skins in said spaced-apart relation, said second composite panel top skin defining said plurality of openings, each of said openings being configured to selectably receive said first horizontal portion of a one of said plurality of channels so that said channel penetrates said opening and said first horizontal portion of said channel is disposed between said top skin and said core of said second composite panel, wherein a selectable engagement between said first horizontal portions of said plurality of channels and said top skin of said second composite panel selectably attaches said second composite panel to said T-shaped beam;

c) said first edge and said second edge being immediately adjacent when said first and second composite panels are attached to said bottom side of said T-shaped beam, whereby said bottom of said T-shaped beam at said first and said second composite panels is covered by said composite panels and is not visible to an observer located inside the clean room.

6. The ceiling system of claim 5, the system further comprising:

a. a second T-shaped beam that is not parallel to said first T-shaped beam, said second T-shaped beam having said bottom side defining said first leg, said bottom side of said second T-shaped beam and said bottom side of said first T-shaped beam in combination defining a ceiling plane, said ceiling plane being mathematical and not being a physical object, said top skin of said first and second composite ceiling panels being coincident with said ceiling plane when said first and second composite ceiling panel are attached to said bottom sides of said first and second T-shaped beams;

b. said plurality of openings defined by said top skin of said first composite panel corresponding to said first leg of said first and said second T-shaped beams, each of said openings being configured to selectably receive said first horizontal portions of said one of said plurality of channels, each of said plurality of channels being configured to selectably attach said top skin of said first composite panel to said first leg of said first or second T-shaped beams, whereby said plurality of channels may selectably attach said first composite panel to said bottom side of said first and second T-shaped beams that are not parallel.

7. The method of claim 2, further comprising:

a) providing a second composite panel having said first edge, said top side, said top skin and said bottom skin, said second composite panel defining said plurality of openings communicating through said top skin, said first and second composite panels being rectangular, said first and second composite panels defining a plurality of other edges;

b) placing said top side of said second composite panel coincident with said ceiling plane and in engagement with said bottom side of said first T-shaped beam and said second T-shaped beam with said first edge of said second composite panel immediately adjacent to said first edge of said first composite panel so that an observer in the clean room cannot see the bottom side of said first and second T-shaped members at said first and second composite panels, at least one of said first edges or said plurality of other edges of said ceiling panels being oblique to said first or second T-shaped beams;

c) inserting said first horizontal portions of said channels through said openings in said top skin of said second composite panel so that said channels penetrate said openings and said first horizontal portions are disposed between said top skin and said bottom skin, whereby said second horizontal portions of said channels are supported by said first and second T-shaped beams and said first horizontal portions of said channels support said second composite panel.

8. The ceiling system of claim 1 wherein said first T-shaped beam is straight and has a longitudinal axis and said first composite panel has a first edge, said first edge is straight, said top skin of said composite panel is flat, said first edge being oblique to said longitudinal axis in plan view when said openings receive said first horizontal portions of said channels and said engagement between said first horizontal portions and said top skin selectably attaches said first composite panel to said first leg of said T-shaped beam.

9. The method of claim 2 wherein said step of providing said composite panel comprises: said composite panel being rectangular, said top side being flat, and wherein said step of placing said top side of said first composite panel in engagement with said bottom side of said first and second T-shaped beams comprises:

placing said first composite panel so that at least one of said first and second T-shaped beams is oblique to said first edge of said first composite panel.

10. A non-walkable clean room ceiling system, the system comprising:

a) a first and second T-shaped beam, said first and second T-shaped beams being attachable to a building structure, said first and second T-shaped beams each being elongated along a longitudinal axis and having a bottom side defining a first leg, said bottom side of the first and second T-shaped beams defining a ceiling plane when said first and second T-shaped beams are attached to said building structure, said ceiling plane being mathematical and not a physical object;

b) a first composite panel, said first composite panel having opposing top and bottom skins in a spaced apart relation and a core disposed between and attached to said top and bottom skins, said first composite panel being rectangular in plan view and defining four edges about a periphery of said composite panel, said first composite panel being attachable to said first legs of said first and second T-shaped beams so that said top skin and said four edges are coincident with said ceiling plane, and so that at least one of said four edges of said composite panel is oblique to said longitudinal axis of said first or said second T-shaped beams; and c) a plurality of channels, each of said channels having a first horizontal portion and a second horizontal portion, said second horizontal portion being configured to selectably engage and to be supported by said first leg of said first T-shaped beam, said second horizontal portion being configured to support said first horizontal portion, said first composite panel top skin defining a plurality of openings communicating through said top skin, each of said openings being configured to selectably receive said first horizontal portion of a one of said plurality of channels so that said channel penetrates said opening and said first horizontal portion is disposed between said top skin and said core, whereby an engagement between said first horizontal portion of said plurality of channels and said top skin of said first composite panel selectably attaches said first composite panel to said first leg of said T-shaped beams.

11. The non-walkable clean room ceiling system of claim 10 wherein said longitudinal axes of said first and second T-shaped beams are non-parallel when said first and second T-shaped beams are attached to the building structure.

* * * * *